US009321582B2

(12) United States Patent
Yildiz

(10) Patent No.: US 9,321,582 B2
(45) Date of Patent: Apr. 26, 2016

(54) STAND-UP PACKAGING APPARATUS FOR A SHIRT

(71) Applicant: Timur Yildiz, Astoria, NY (US)

(72) Inventor: Timur Yildiz, Astoria, NY (US)

( * ) Notice: Subject to any disclaimer, the term of this patent is extended or adjusted under 35 U.S.C. 154(b) by 260 days.

(21) Appl. No.: 14/070,307

(22) Filed: Nov. 1, 2013

(65) Prior Publication Data

US 2014/0116905 A1 May 1, 2014

Related U.S. Application Data

(60) Provisional application No. 61/721,218, filed on Nov. 1, 2012.

(51) Int. Cl.
*B65D 85/18* (2006.01)
*B65D 30/20* (2006.01)

(52) U.S. Cl.
CPC ..... *B65D 85/182* (2013.01); *B65D 31/10* (2013.01)

(58) Field of Classification Search
CPC ..... B65D 85/152; B65D 31/10
See application file for complete search history.

(56) References Cited

U.S. PATENT DOCUMENTS 3,945,415 A * 3/1976 Febuary ..... A45C 13/02 206/282
5,059,036 A * 10/1991 Richison ..... B31B 19/90 383/102
6,070,720 A * 6/2000 Johnson ..... B65D 85/18 206/279
6,231,237 B1 * 5/2001 Geller ..... B29C 65/18 220/9.1
6,341,895 B1 * 1/2002 Tani ..... B65D 31/16 383/104
6,422,752 B1 * 7/2002 Hoffner ..... B65D 33/06 383/15
6,708,819 B1 * 3/2004 Lee ..... B65D 31/12 190/13 R
6,719,140 B1 * 4/2004 Rinsler ..... A45C 11/20 206/541
6,857,779 B2 * 2/2005 Olin ..... B65D 33/2533 383/104
D544,366 S * 6/2007 Heisler ..... D9/631
2004/0096127 A1 * 5/2004 Rosn ..... B65D 75/5866 383/44
2004/0131284 A1 * 7/2004 Stolmeier ..... B65D 31/10 383/64
2011/0253567 A1 * 10/2011 Cossey ..... B65D 31/10 206/287

* cited by examiner

*Primary Examiner* — Tri Mai

(57) ABSTRACT

A stand-up packaging apparatus for a shirt includes a shirt shaped front panel, a shirt shaped back panel, a top seal, an attachment mechanism, a gusset base, an interior chamber, and a top opening. The shirt shaped front panel and the back panel are perimetrically connected to each other except around a shoulder edge of the shirt shaped front panel and the back panel. The gusset base is connected in between a base edge of the shirt shaped front panel and the back panel so that the stand-up packaging apparatus for a shirt is able to stand-up on a flat surface. The interior chamber is positioned with the shirt shaped front panel and the back panel and accessed through the top opening, which is opened through the top seal and the attachment mechanism. The attachment mechanism also shuts the top opening when necessary.

15 Claims, 10 Drawing Sheets

STAND-UP PACKAGING APPARATUS FOR A SHIRT

The current application claims a priority to the U.S. Provisional Patent application Ser. No. 61/721,218 filed on Nov. 1, 2012.

FIELD OF THE INVENTION

The present invention relates generally to flexible packaging. Specifically, the present invention is a shirt shaped packaging apparatus that is capable of standing on a flat surface. The present invention is available in one-time use and reusable variations. Pursuant to these two variations, the present invention may be opened using a tear notch and sealed using an attachment mechanism. The present invention is intended to provide sufficient protection for inner contents without being cumbersome.

BACKGROUND OF THE INVENTION

Lightweight, durable, and element resistant packaging is essential for the safekeeping and transport of sensitive goods. Products such as pharmaceuticals are often packaged in flimsy paper envelopes. While this packaging is lightweight, it is prone to ripping and tearing easily, particularly if wet. The packaging does not have a reliable means of sealing which can lead to the products contained within spilling and becoming lost or damaged. The present invention seeks to provide an improved type of packaging that may be used for a wide variety of functions and that addresses the inherent issues of current styles of similar packaging.

The present invention is a shirt shaped packaging apparatus that is capable of standing on a flat surface and that may be reliably sealed. The packaging apparatus is manufactured from a flexible material that may expand in order to accommodate larger amounts of interior contents. The material is lightweight, durable, and element resistant in order to protect interior contents without being unnecessarily burdensome. The present invention features a gusseted base that allows the packaging apparatus to stand up on a flat surface. The gusseted base allows the packaging apparatus and any contents to be stored standing upright. This is convenient as bulky contents within the packaging apparatus may make it difficult to lay the packaging apparatus on a flat surface. The gusseted base also assists the packaging apparatus in expanding according to the interior contents. The packaging apparatus may also be stored on extruded hooks or pegs by means of a hang hole present on the packaging apparatus. The hang hole allows the packaging apparatus to be displayed using standard display equipment found in retail stores. The present invention may be reliably sealed and is available in both one-time use and reusable variations. The packaging apparatus may be sealed and opened using a tear notch and a zipper. The present invention may be manufactured from a wide variety of materials including, but not limited to, paper, plastic, glass, and fabric. The present invention is useful as it provides protection for inner contents from the exterior environment.

DETAIL DESCRIPTIONS OF THE INVENTION

Figure 1:
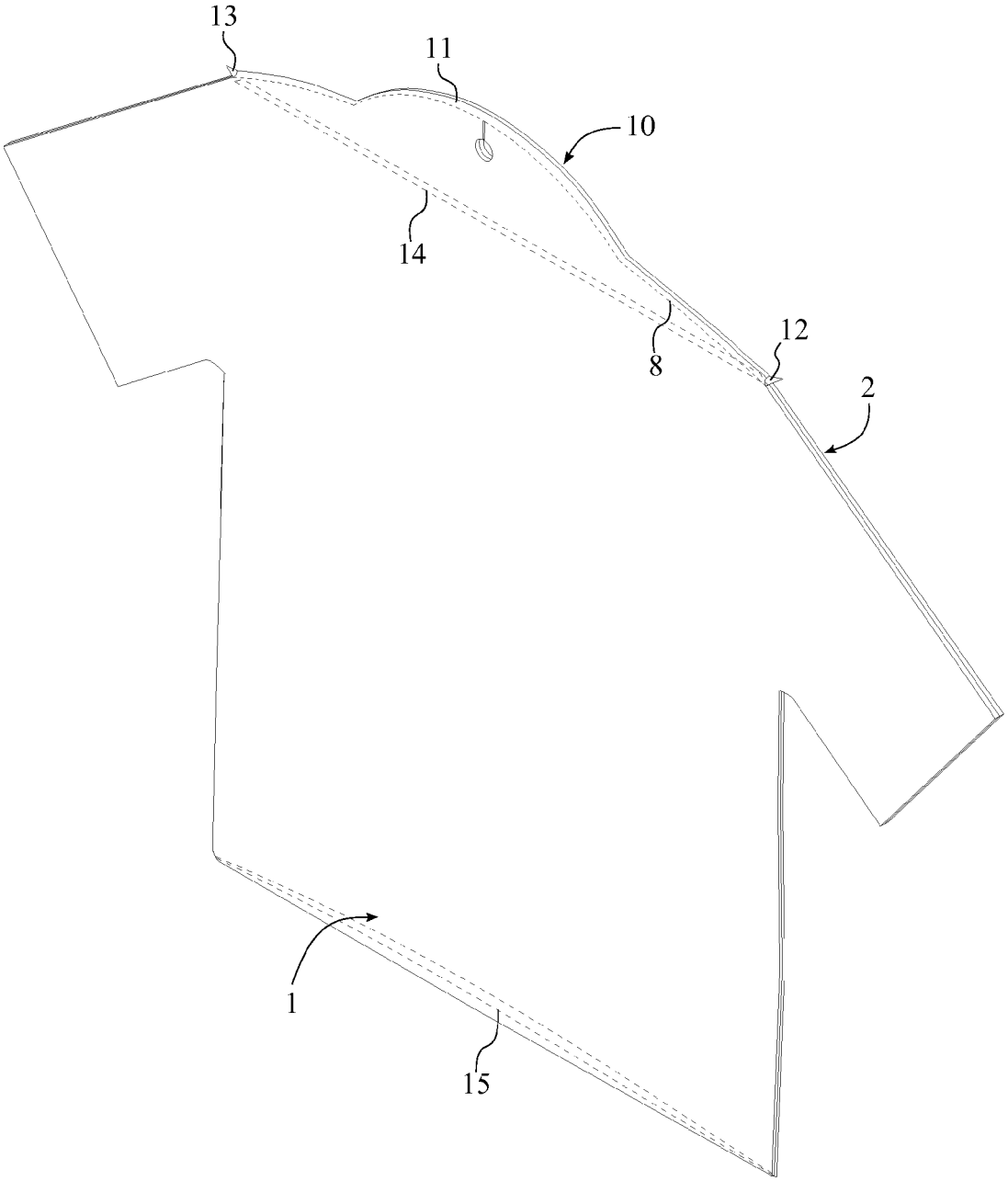
FIG. 1 is an isometric view of the preferred embodiment of the present invention featuring the top seal and the attachment mechanism, wherein the dash lines illustrate the attachment mechanism of the present invention.

All illustrations of the drawings are for the purpose of describing selected versions of the present invention and are not intended to limit the scope of the present invention.

The present invention is a shirt shaped stand-up packaging apparatus that is gusseted to allow the packaging apparatus to stand on a flat surface. The stand-up packaging apparatus reliably protects an unfolded shirt or an unfolded t-shirt from the exterior environment, where the stand-up packaging apparatus is available in one-time use and reusable variants. The present invention is preferably made from flexible, thin, lightweight, durable, and resistant to the elements materials so that the stand-up packaging apparatus is able to protect the stored content. Examples of materials of the packaging apparatus include, but are not limited to, paper, plastic, fabric, and any combination thereof. The present invention comprises a shirt shaped front panel 1, a shirt shaped back panel 2, a top seal 10, an attachment mechanism 14, a gusset base 15, an interior chamber 16, and a top opening 17.

Figure 3:
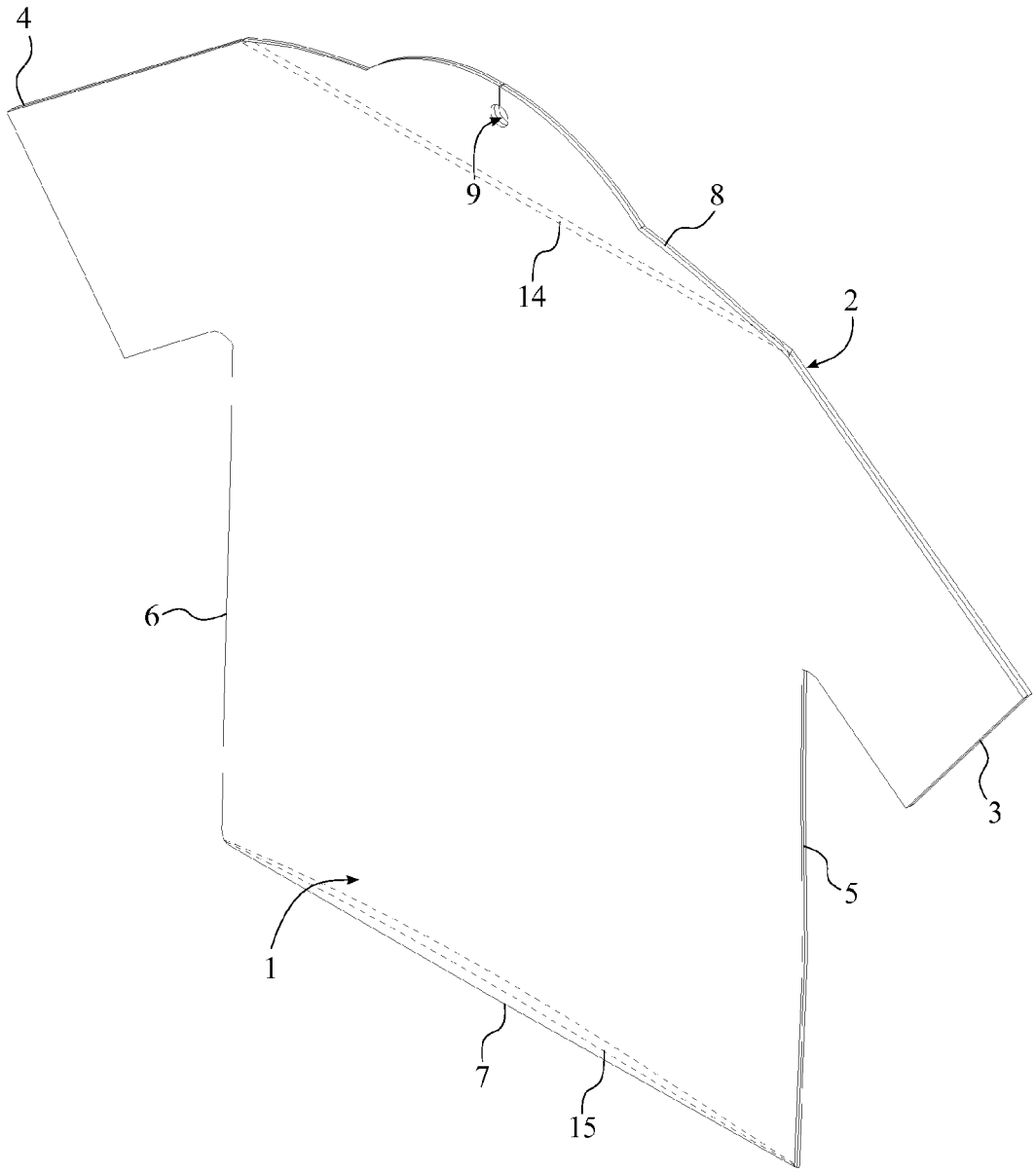
FIG. 3 is an isometric view of the preferred embodiment of the present invention featuring the attachment mechanism without the top seal, wherein the dash lines illustrate the attachment mechanism of the present invention.

Referring to FIG. 1 and FIG. 3, the shirt shaped front panel 1 and the shirt shaped back panel 2 each comprise a left arm edge 3, a right arm edge 4, a left torso edge 5, a right torso edge 6, a base edge 7, a shoulder edge 8, and a hanging hole 9. The left arm edge 3 is adjacently connected with the left torso edge 5 as the left arm edge 3 is positioned atop the left torso edge 5. Similarly, the right arm edge 4 is adjacently connected with the right torso edge 6 as the right arm edge 4 is positioned atop the right torso edge 6. The left arm edge 3 and the left torso edge 5 are oppositely positioned from the right arm edge 4 and the right torso edge 6 creating the left side and the right side for the present invention. The base edge 7 is adjacently connected with the left torso edge 5 and the right torso edge 6, where the base edge 7 is oppositely positioned from the left arm edge 3 and the right arm edge 4 along the left torso edge 5 and the right torso edge 6. The shoulder edge 8 is adjacently connected with the left arm edge 3 and the right arm edge 4 in such way that the shoulder edge 8 oppositely positions from the base edge 7. The hanging hole 9 is adjacently positioned with the shoulder edge 8 in between the left arm edge 3 and the right arm edge 4. More specifically, the hanging hole 9 is symmetrically positioned with the left arm edge 3 and the right arm edge 4.

Figure 4:
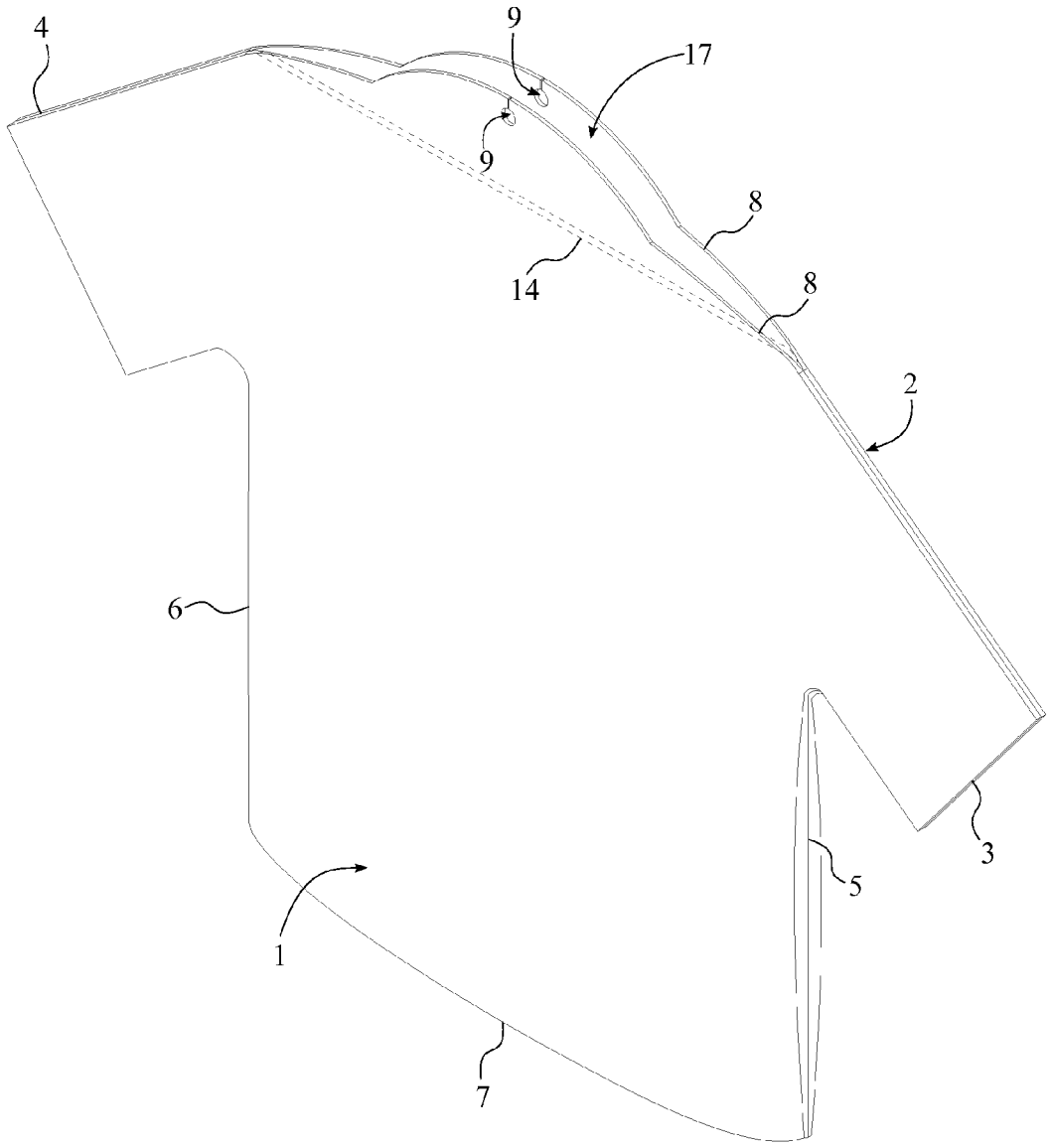
FIG. 4 is an isometric view of the preferred embodiment of the present invention featuring the attachment mechanism and the top opening without the top seal, wherein the dash lines illustrate hidden sections of the attachment mechanism of the present invention.

With respect to FIG. 1, FIG. 3, FIG. 4, in order to create the shirt shaped stand-up packaging apparatus for the preferred embodiment of the present invention, the shirt shaped front panel 1 and the shirt shaped back panel 2 are laid flush against one another and connected to each other through the left arm edge 3, the right arm edge 4, the left torso edge 5, the right torso edge 6, and the base edge 7. More specifically, the left arm edge 3 of the shirt shaped front panel 1 is directly connected with the left arm edge 3 of the shirt shaped back panel 2, and the right arm edge 4 of the shirt shaped front panel 1 is directly connected with the right arm edge 4 of the shirt shaped back panel 2. Moreover, the left torso edge 5 and the right torso edge 6 of the shirt shaped front panel 1 are respectively and directly connected with the left torso edge 5 and the right torso edge 6 of the shirt shaped back panel 2 while the gusset base 15 is connected with the base edges 7 of the shirt shaped front panel 1 and the shirt shaped back panel 2.

Figure 7:
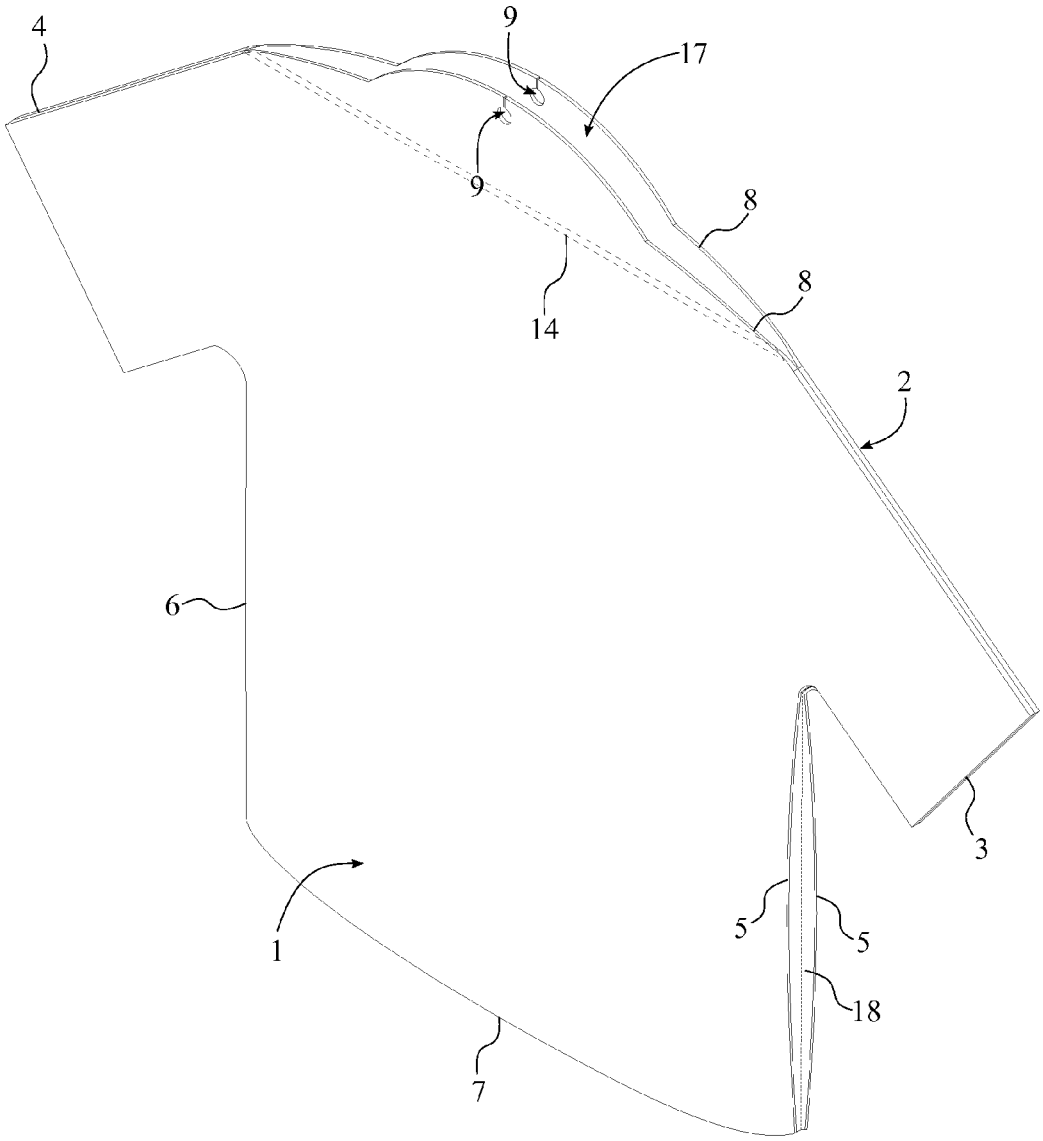
FIG. 7 is an isometric view of the alternative embodiment of the present invention featuring the left gusset panel.
Figure 8:
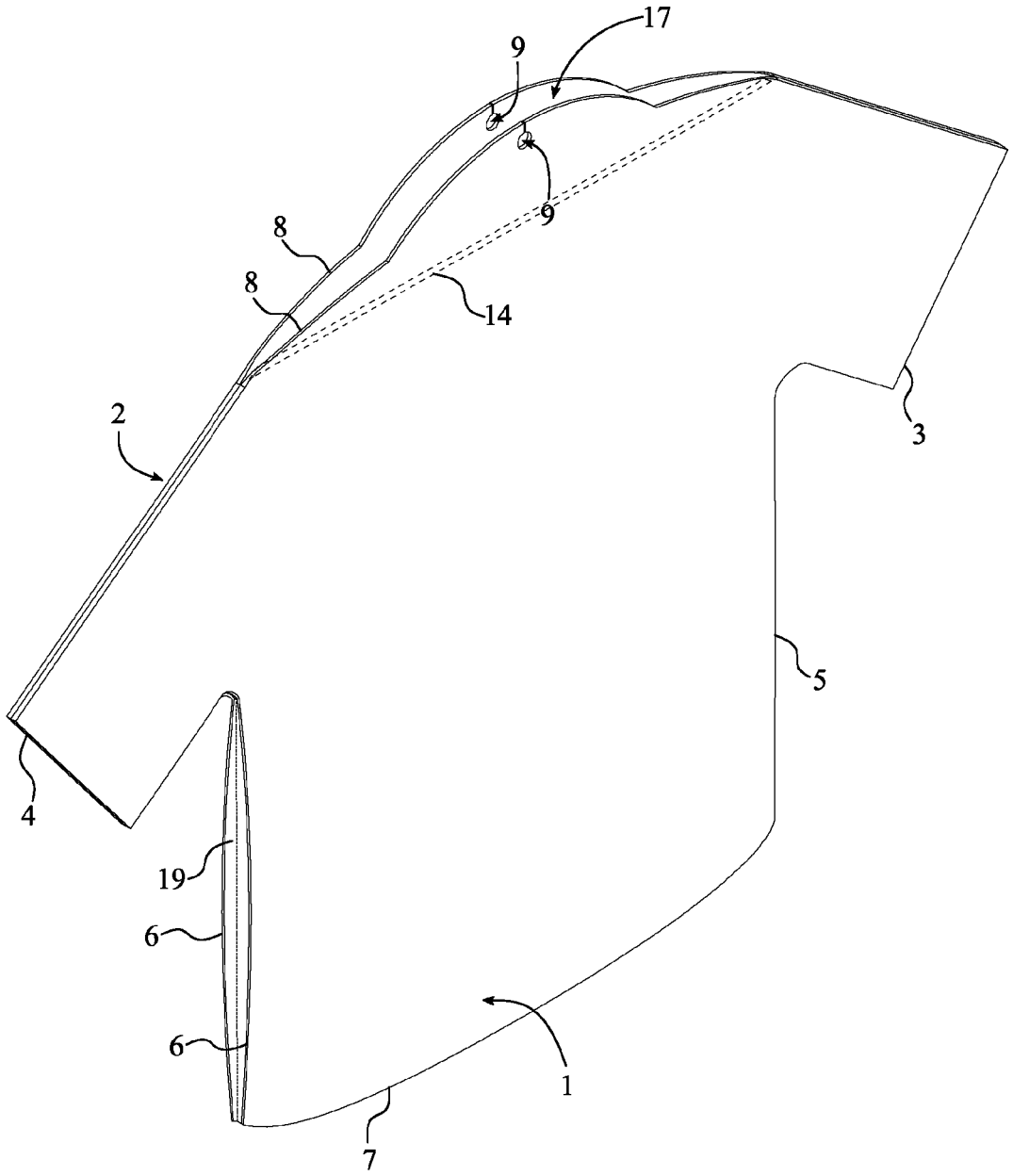
FIG. 8 is an isometric view of the alternative embodiment of the present invention featuring the right gusset panel.

With respect to FIG. 7, FIG. 8, in order to create the shirt shaped stand-up packaging apparatus for the alternative embodiment of the present invention, the shirt shaped front panel 1 and the shirt shaped back panel 2 are laid flush against one another and connected to each other through the left arm edge 3, the right arm edge 4, the left torso edge 5, the right torso edge 6, and the base edge 7. More specifically, the left arm edge 3 of the shirt shaped front panel 1 is directly connected with the left arm edge 3 of the shirt shaped back panel 2, and the right arm edge 4 of the shirt shaped front panel 1 is directly connected with the right arm edge 4 of the shirt shaped back panel 2. Moreover, the left torso edge 5 of the shirt shaped front panel 1 is jointly connected with the left torso edge 5 of the shirt shaped back panel 2 by a left gusset panel 18, and the right torso edge 6 of the shirt shaped front panel 1 is jointly connected with the right torso edge 6 of the shirt shaped back panel 2 by a right gusset panel 19 while the gusset base 15 is connected with the base edge 7 of the shirt shaped front panel 1 and the shirt shaped back panel 2. The left gusset panel 18 and the right gusset panel 19 provide extra space within the alternative embodiment as the left gusset panel 18 and the right gusset panel 19 expands in relation to the stored content.

Figure 5:
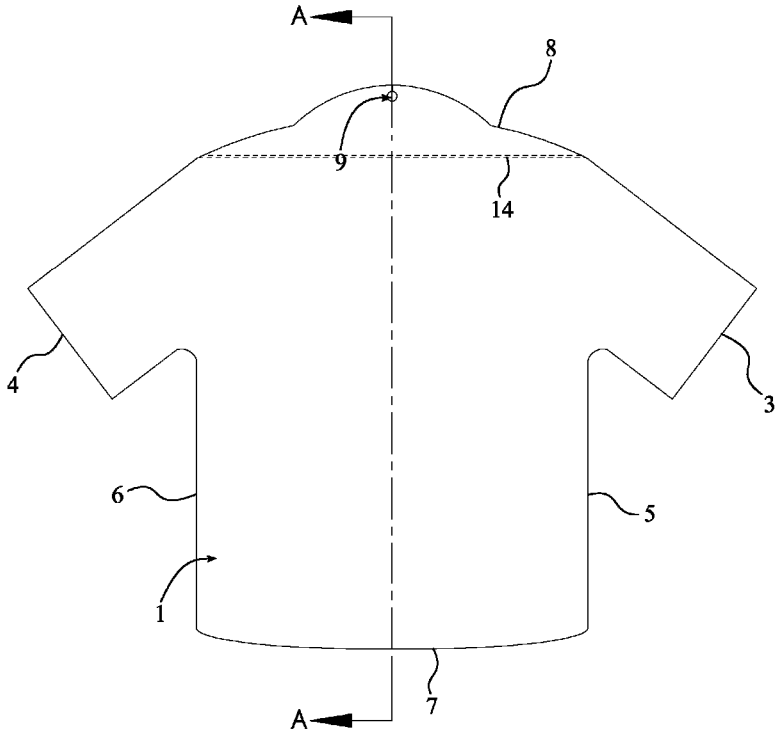
FIG. 5 is a front view of the preferred embodiment of the present invention featuring the attachment mechanism without the top seal, showing the plane upon which a cross sectional view is taken shown in FIG. 6.
Figure 6:
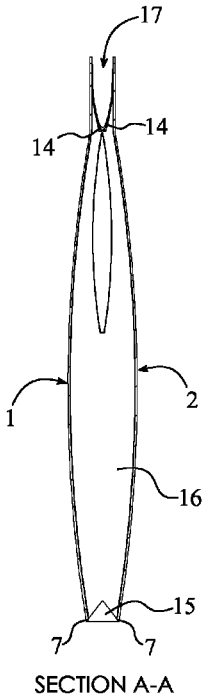
FIG. 6 is a cross section view thereof taken along line A-A of FIG. 5.

With respect to FIG. 5 and FIG. 6, the gusset base 15, which comprises a crease and a pair of folding panels, cleanly secures the bottom edge of the stored t-shirt or the stored shirt within the present invention. The pair of folding panels is separated by the creased and folds in and up towards the top portion of the stored t-shirt or the stored shirt to form an upside-down "V" shape. The gusset base 15 allows the present invention to position in a vertical direction as the surface area of the gusset base 15 allows the present invention to stand up on a flat surface.

In reference to FIG. 1 and FIG. 5, when the shirt shaped front panel 1 and the shirt shaped back panel 2 are connected to each other, the hanging holes 9 are aligned with each other. The hanging holes 9 provide an alternative storage method compare to standing upright on a flat surface, where the hanging holes 9 may be used to place the present invention onto a hook or a peg during storage. Additionally, the hanging holes 9 allow the present invention to be displayed using standard product display equipment found in retail stores.

In reference to FIG. 4 and FIG. 6, the interior chamber 16 which provides the space for stored content is positioned within the left arm edge 3, the left torso edge 5, the base edge 7, the right torso edge 6, the right arm edge 4, and the shoulder edge 8 of the shirt shaped front panel 1 and the shirt shaped back panel 2. The interior chamber 16 is sealed entirely within the left arm edge 3, the left torso edge 5, the base edge 7, the right torso edge 6, and the right arm edge 4 of the shirt shaped front panel 1 and the shirt shaped back panel 2 while the top opening 17 provides access to the interior chamber 16. The top opening 17 is positioned in between the shoulder edge 8 of the shirt shaped front panel 1 and the shirt shaped back panel 2, where the top opening 17 may be expanded to enlarge the interior chamber 16 and to place content into the interior chamber 16. The top opening 17 is closed by the top seal 10 and the attachment mechanism 14 so that the stored content can be completely protected, where the attachment mechanism 14 is positioned below the hanging holes 9 and the top seal 10 is positioned above the hanging holes 9.

Figure 2:
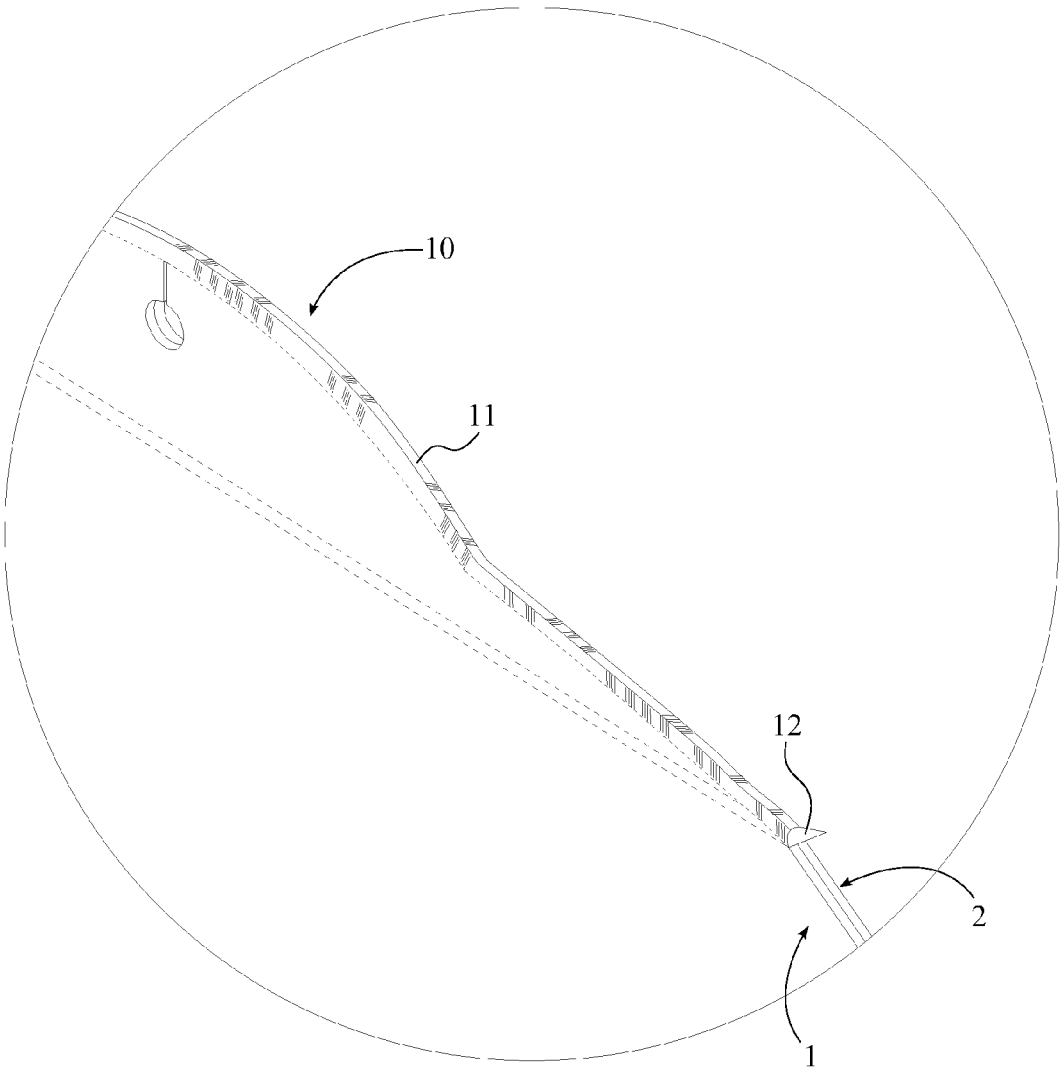
FIG. 2 is an isometric detail view of the top seal of the present invention.

In reference to FIG. 1 and FIG. 2, the top seal 10 which functions as a one-time used seal within the top opening 17 comprises a connecting member 11, a left tear notch 12, and a right tear notch 13. The left tear notch 12 and the right tear notch 13 are connected to the connecting member 11, where the left tear notch 12 and the right tear notch 13 are oppositely positioned from each other along the connecting member 11. The connecting member 11 is attached with the shoulder edge 8 of the shirt shaped front panel 1 and the shirt shaped back panel 2 in such way that the interior chamber 16 is completely sealed from outside elements. Since the left tear notch 12 and the right tear notch 13 are not connected to the shoulder edges 8, the user may use either the left tear notch 12 or the right tear notch 13 to easily break the connecting member 11 away from the shoulder edges 8 so that the attachment mechanism 14 can be accessed through the top opening 17.

In reference to FIG. 4, the attachment mechanism 14 is adjacently connected with the with the shoulder edge 8 of the shirt shaped front panel 1 and the shirt shaped back panel 2 providing access to the interior chamber 16. The attachment mechanism 14 functions as the reusable seal within the present invention as the user can either open the attachment mechanism 14 which provides access to the interior chamber 16 or close the attachment mechanism 14 which restricts access to the interior chamber 16. Even though a coil zipper is used as the preferred attachment mechanism 14 within the present invention, the attachment mechanism 14 of the present invention can include, but is not limited to, zipper fasteners, magnetic fasteners, hook-and-loop fasteners, and other similar fasteners.

Figure 9:
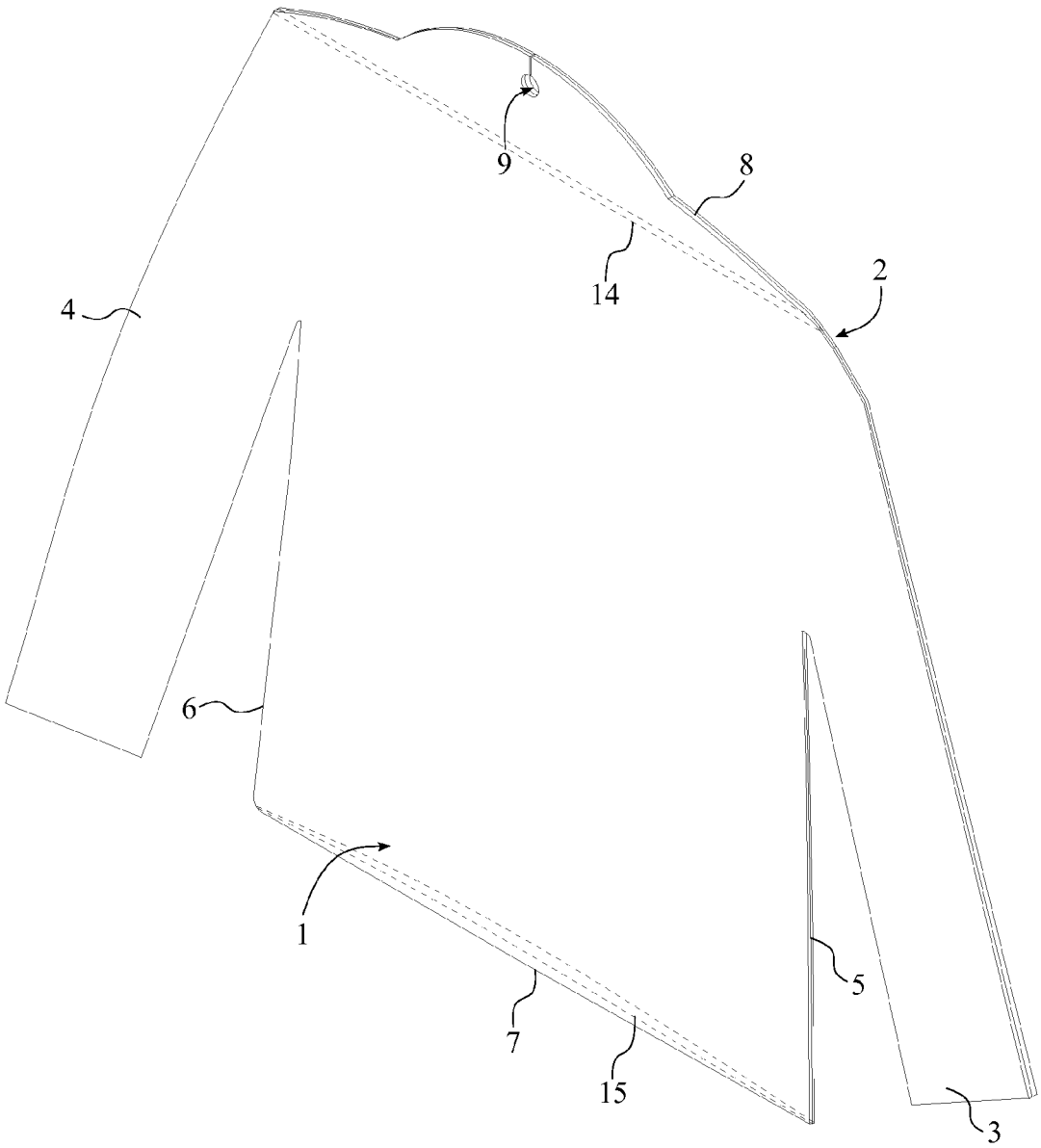
FIG. 9 is an isometric view of the present invention showing the long-sleeved shirt.
Figure 10:
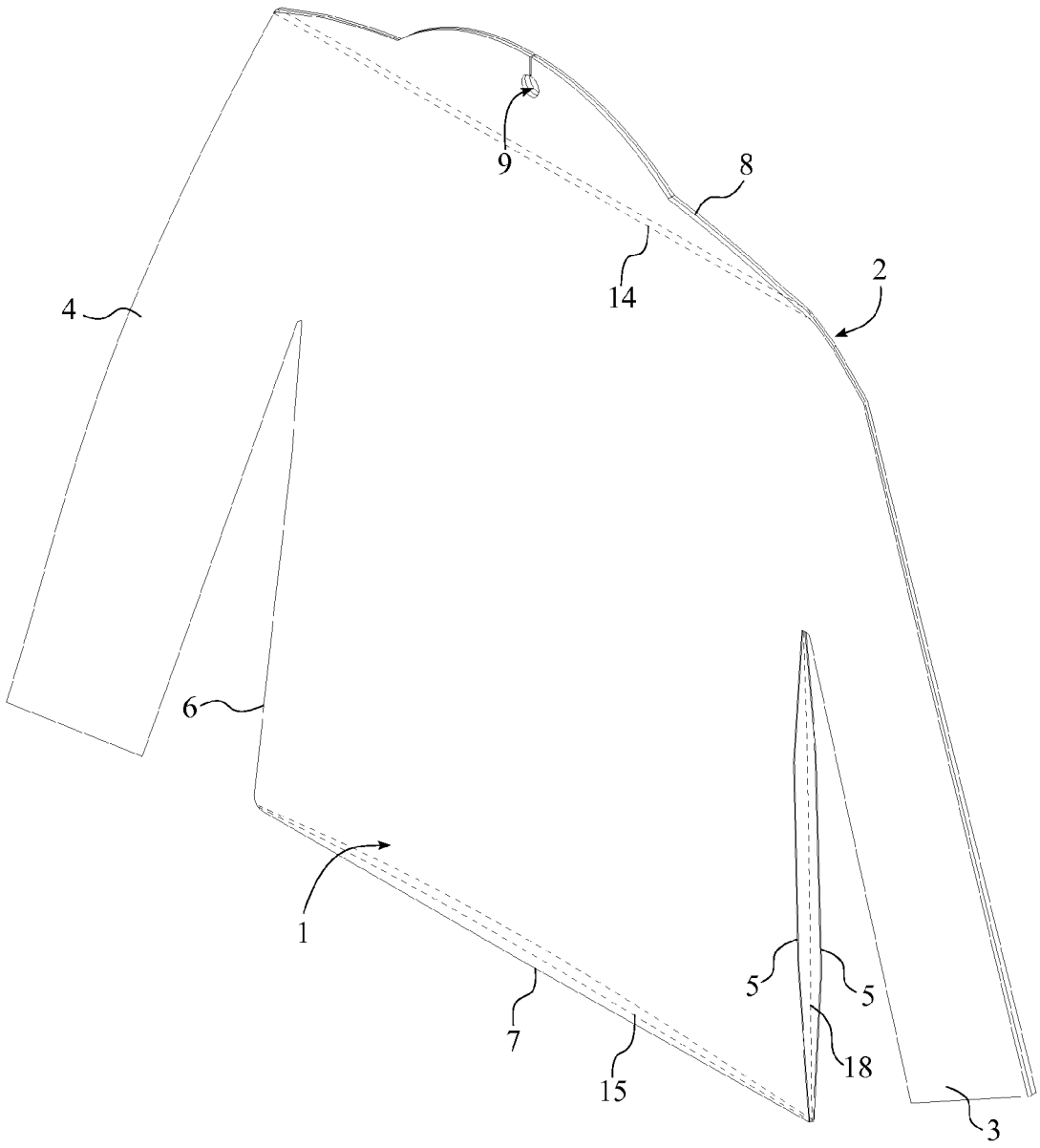
FIG. 10 is an isometric view of the present invention featuring the left gusset panel of the long-sleeved shirt.
Figure 11:
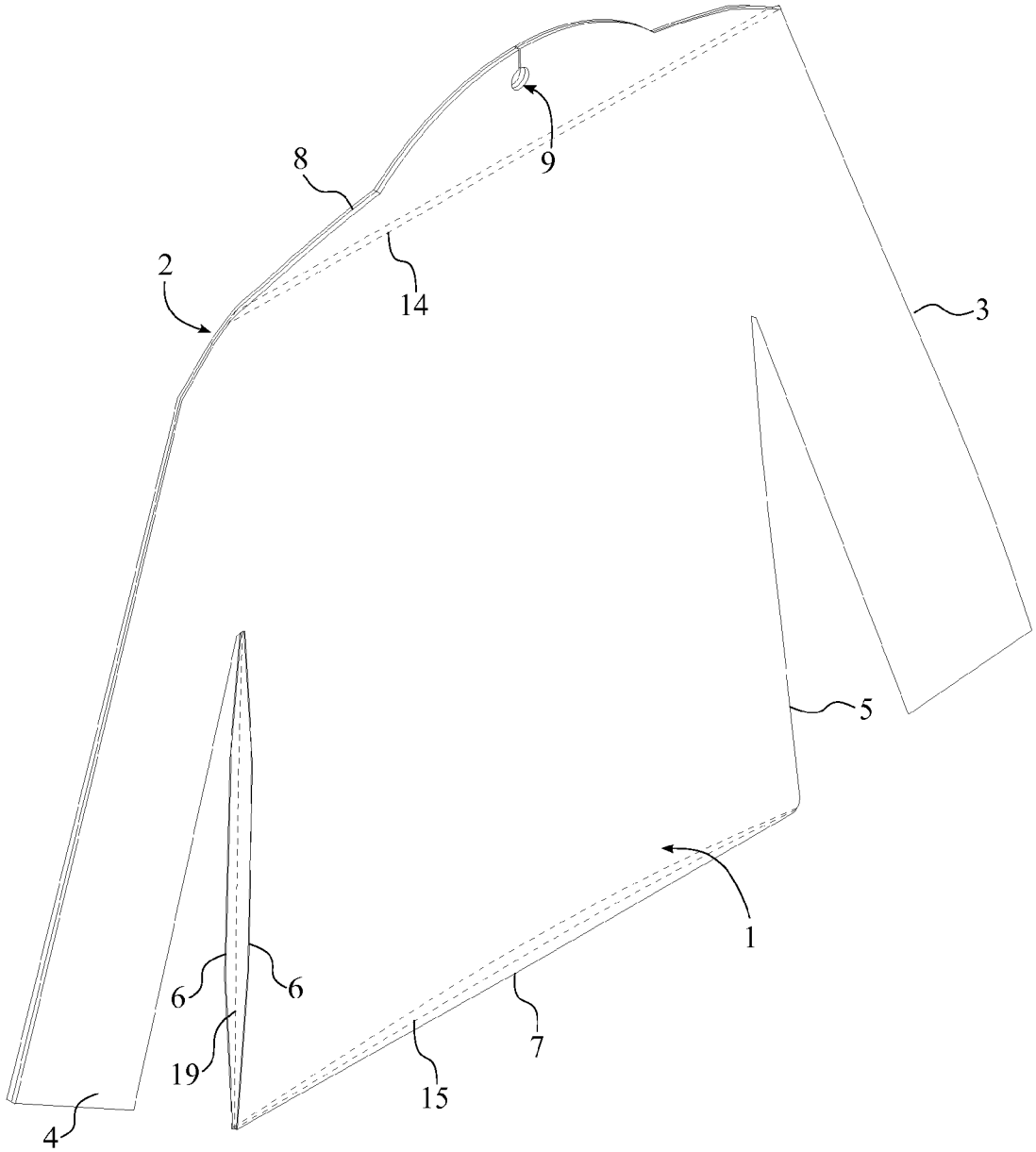
FIG. 11 is an isometric view of the present invention featuring the right gusset panel of the long-sleeved shirt.

The present invention is not limited with regards to size and may be manufactured in a variety of sizes. This allows the present invention to accommodate any size of garment with respect to vacuum packaging or regular packaging. In the preferred embodiment of the present invention, the packaging apparatus features a short-sleeved shirt design. However, alternative embodiments of the present invention, which is shown in FIG. 9, FIG. 10, and FIG. 11, may be available in the long-sleeved shirt designs as the left arm edge 3 and the right arm edge 4 extend adjacent to the base edge 7.

Although the invention has been explained in relation to its preferred embodiment, it is to be understood that many other possible modifications and variations can be made without departing from the spirit and scope of the invention as hereinafter claimed.

What is claimed is:

1. A stand-up packaging apparatus for a shirt comprises:

a shirt shaped front panel;

a shirt shaped back panel;

a top seal;

an attachment mechanism;

a gusset base;

an interior chamber;

a top opening;

the shirt shaped front panel and the shirt shaped back panel each comprise a left arm edge, a right arm edge, a left torso edge, a right torso edge, a base edge, a shoulder edge, and a hanging hole;

the top seal comprises a connecting member, a left tear notch, and a right tear notch;

the interior chamber being positioned within the left arm edge, the left torso edge, the base edge, the right torso edge, the right arm edge, and the shoulder edge of the shirt shaped front panel and the shirt shaped back panel;

the top opening being positioned in between the shoulder edge of the shirt shaped front panel and the shirt shaped back panel;

the left tear notch being connected to the connecting member;

the right tear notch being connected to the connecting member;

the left tear notch and the right tear notch being oppositely positioned from each other along the connecting member;

the connecting member being attached with the shoulder edge of the shirt shaped front panel and the shirt shaped back panel;

the attachment mechanism being adjacently connected with the shoulder edge of the shirt shaped front panel and the shirt shaped back panel; and the attachment mechanism being positioned below the hanging hole.

2. The stand-up packaging apparatus for a shirt as claimed in claim 1 comprises:

the left arm edge being adjacently connected with the left torso edge;

the left arm edge being positioned atop the left torso edge;

the right arm edge being adjacently connected with the right torso edge;

the right arm edge being positioned atop the right torso edge;

the left arm edge and the left torso edge being oppositely positioned from the right arm edge and the right torso edge;

the base edge being adjacently connected with the left torso edge and the right torso edge;

the base edge being oppositely positioned from the left arm edge and the right arm edge along the left torso edge and the right torso edge;

the shoulder edge being connected with the left arm edge and the right arm edge;

the shoulder edge being oppositely positioned from the base edge; and the hanging hole being adjacently positioned with the shoulder edge in between the left arm edge and the right arm edge.

3. The stand-up packaging apparatus for a shirt as claimed in claim 1 comprises:

the left arm edge of the shirt shaped front panel being directly connected with the left arm edge of the shirt shaped back panel;

the right arm edge of the shirt shaped front panel being directly connected with the right arm edge of the shirt shaped back panel;

the left torso edge of the shirt shaped front panel being connected with the left torso edge of the shirt shaped back panel;

the right torso edge of the shirt shaped front panel being connected with the right torso edge of the shirt shaped back panel; and the gusset base being connected with the base edge of the shirt shaped front panel and the shirt shaped back panel.

4. The stand-up packaging apparatus for a shirt as claimed in claim 3 comprises:

the left torso edge of the shirt shaped front panel and the left torso edge of the shirt shaped back panel being directly connected to each other; and the right torso edge of the shirt shaped front panel and the right torso edge of the shirt shaped back panel being directly connected to each other.

5. The stand-up packaging apparatus for a shirt as claimed in claim 3 comprises:

the left torso edge of the shirt shaped front panel and the left torso edge of the shirt shaped back panel being jointly connected to each other by a left gusset panel; and the right torso edge of the shirt shaped front panel and the right torso edge of the shirt shaped back panel being jointly connected to each other by a right gusset panel.

6. A stand-up packaging apparatus for a shirt comprises:

a shirt shaped front panel;

a shirt shaped back panel;

a top seal;

an attachment mechanism;

a gusset base;

an interior chamber;

a top opening;

the shirt shaped front panel and the shirt shaped back panel each comprise a left arm edge, a right arm edge, a left torso edge, a right torso edge, a base edge, a shoulder edge, and a hanging hole;

the top seal comprises a connecting member, a left tear notch, and a right tear notch;

the left arm edge being adjacently connected with the left torso edge;

the left arm edge being positioned atop the left torso edge;

the right arm edge being adjacently connected with the right torso edge;

the right arm edge being positioned atop the right torso edge;

the left arm edge and the left torso edge being oppositely positioned from the right arm edge and the right torso edge;

the base edge being adjacently connected with the left torso edge and the right torso edge;

the base edge being oppositely positioned from the left arm edge and the right arm edge along the left torso edge and the right torso edge;

the shoulder edge being connected with the left arm edge and the right arm edge;

the shoulder edge being oppositely positioned from the base edge;

the hanging hole being adjacently positioned with the shoulder edge in between the left arm edge and the right arm edge;

the attachment mechanism being adjacently connected with the shoulder edge of the shirt shaped front panel and the shirt shaped back panel; and the attachment mechanism being positioned below the hanging hole.

7. The stand-up packaging apparatus for a shirt as claimed in claim 6 comprises:

the left arm edge of the shirt shaped front panel being directly connected with the left arm edge of the shirt shaped back panel;

the right arm edge of the shirt shaped front panel being directly connected with the right arm edge of the shirt shaped back panel;

the left torso edge of the shirt shaped front panel and the left torso edge of the shirt shaped back panel being directly connected to each other;

the right torso edge of the shirt shaped front panel and the right torso edge of the shirt shaped back panel being directly connected to each other; and the gusset base being connected with the base edge of the shirt shaped front panel and the shirt shaped back panel.

8. The stand-up packaging apparatus for a shirt as claimed in claim 6 comprises:

the left arm edge of the shirt shaped front panel being directly connected with the left arm edge of the shirt shaped back panel;

the right arm edge of the shirt shaped front panel being directly connected with the right arm edge of the shirt shaped back panel;

the left torso edge of the shirt shaped front panel and the left torso edge of the shirt shaped back panel being jointly connected to each other by a left gusset panel;

the right torso edge of the shirt shaped front panel and the right torso edge of the shirt shaped back panel being jointly connected to each other by a right gusset panel; and the gusset base being connected with the base edge of the shirt shaped front panel and the shirt shaped back panel.

9. The stand-up packaging apparatus for a shirt as claimed in claim 6 comprises:

the interior chamber being positioned within the left arm edge, the left torso edge, the base edge, the right torso edge, the right arm edge, and the shoulder edge of the shirt shaped front panel and the shirt shaped back panel; and the top opening being positioned in between the shoulder edge of the shirt shaped front panel and the shirt shaped back panel.

10. The stand-up packaging apparatus for a shirt as claimed in claim 6 comprises:

the left tear notch being connected to the connecting member;

the right tear notch being connected to the connecting member;

the left tear notch and the right tear notch being oppositely positioned from each other along the connecting member; and the connecting member being attached with the shoulder edge of the shirt shaped front panel and the shirt shaped back panel.

11. A stand-up packaging apparatus for a shirt comprises:

a shirt shaped front panel;

a shirt shaped back panel;

a top seal;

an attachment mechanism;

a gusset base;

an interior chamber;

a top opening;

the shirt shaped front panel and the shirt shaped back panel each comprise a left arm edge, a right arm edge, a left torso edge, a right torso edge, a base edge, a shoulder edge, and a hanging hole;

the top seal comprises a connecting member, a left tear notch, and a right tear notch;

the left arm edge being adjacently connected with the left torso edge;

the left arm edge being positioned atop the left torso edge;

the right arm edge being adjacently connected with the right torso edge;

the right arm edge being positioned atop the right torso edge;

the left arm edge and the left torso edge being oppositely positioned from the right arm edge and the right torso edge;

the base edge being adjacently connected with the left torso edge and the right torso edge;

the base edge being oppositely positioned from the left arm edge and the right arm edge along the left torso edge and the right torso edge;

the shoulder edge being connected with the left arm edge and the right arm edge;

the shoulder edge being oppositely positioned from the base edge;

the hanging hole being adjacently positioned with the shoulder edge in between the left arm edge and the right arm edge;

the left arm edge of the shirt shaped front panel being directly connected with the left arm edge of the shirt shaped back panel;

the right arm edge of the shirt shaped front panel being directly connected with the right arm edge of the shirt shaped back panel;

the left torso edge of the shirt shaped front panel being connected with the left torso edge of the shirt shaped back panel;

the right torso edge of the shirt shaped front panel being connected with the right torso edge of the shirt shaped back panel;

the gusset base being connected with the base edge of the shirt shaped front panel and the shirt shaped back panel, the interior chamber being positioned within the left arm edge, the left torso edge, the base edge, the right torso edge, the right arm edge, and the shoulder edge of the shirt shaped front panel and the shirt shaped back panel; and the top opening being positioned in between the shoulder edge of the shirt shaped front panel and the shirt shaped back panel.

12. The stand-up packaging apparatus for a shirt as claimed in claim 11 comprises:

the left torso edge of the shirt shaped front panel and the left torso edge of the shirt shaped back panel being directly connected to each other; and the right torso edge of the shirt shaped front panel and the right torso edge of the shirt shaped back panel being directly connected to each other.

13. The stand-up packaging apparatus for a shirt as claimed in claim 11 comprises:

the left torso edge of the shirt shaped front panel and the left torso edge of the shirt shaped back panel being jointly connected to each other by a left gusset panel; and the right torso edge of the shirt shaped front panel and the right torso edge of the shirt shaped back panel being jointly connected to each other by a right gusset panel.

14. The stand-up packaging apparatus for a shirt as claimed in claim 11 comprises:

the left tear notch being connected to the connecting member;

the right tear notch being connected to the connecting member;

the left tear notch and the right tear notch being oppositely positioned from each other along the connecting member; and the connecting member being attached with the shoulder edge of the shirt shaped front panel and the shirt shaped back panel.

15. The stand-up packaging apparatus for a shirt as claimed in claim 11 comprises:

the attachment mechanism being adjacently connected with the shoulder edge of the shirt shaped front panel and the shirt shaped back panel; and the attachment mechanism being positioned below the hanging hole.

* * * * *